US008834644B2

(12) United States Patent
Heisele et al.

(10) Patent No.: US 8,834,644 B2
(45) Date of Patent: Sep. 16, 2014

(54) APPARATUS AND METHOD FOR THE OPERATION OF A DISHWASHER

(75) Inventors: Bernd Heisele, Sontheim (DE); Stephan Lutz, Sontheim (DE); Michael Rosenbauer, Reimlingen (DE); Franz-Josef Wagner, Nördlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 729 days.

(21) Appl. No.: 12/674,724

(22) PCT Filed: Aug. 25, 2008

(86) PCT No.: PCT/EP2008/061086

§ 371 (c)(1),
(2), (4) Date: Feb. 23, 2010

(87) PCT Pub. No.: WO2009/027372

PCT Pub. Date: Mar. 5, 2009

(65) Prior Publication Data

US 2011/0120500 A1 May 26, 2011

(30) Foreign Application Priority Data

Aug. 31, 2007 (DE) ..... 10 2007 041 299

(51) Int. Cl.

| | |
|---|---|
| ***B08B 3/00*** | (2006.01) |
| ***A47L 15/00*** | (2006.01) |
| ***A47L 15/42*** | (2006.01) |

(52) U.S. Cl.

CPC ..... *A47L 15/0049* (2013.01); *A47L 2501/36* (2013.01); *A47L 15/4221* (2013.01); *A47L 2501/04* (2013.01); *A47L 2501/03* (2013.01); *A47L 2401/34* (2013.01)

USPC ..... 134/56 D; 134/57 D; 134/58 D

(58) Field of Classification Search
None
See application file for complete search history.

(56) References Cited

U.S. PATENT DOCUMENTS

| | | | |
|---|---|---|---|
| 7,301,300 | B2 | 11/2007 | Larsson |
| 2004/0173249 | A1 | 9/2004 | Assmann et al. |

FOREIGN PATENT DOCUMENTS

| | | | |
|---|---|---|---|
| CN | 1778253 | A | 5/2006 |
| DE | 3209542 | C1 | 4/1984 |
| DE | 19857101 | B4 | 4/2004 |
| EP | 0383028 | A2 | 8/1990 |
| EP | 0705561 | A1 | 4/1996 |
| EP | 1042982 | A1 | 10/2000 |
| EP | 1676520 | A2 | 7/2006 |

OTHER PUBLICATIONS

Foreign Patent Office Report—CN in the Chinese language report a typographical occurs throughout the report, mistakenly referring to the cited reference as DE 0383028 A2, instead of EP 0383028 A2, which was previously cited in applicants initial IDS.

*Primary Examiner* — Eric Golightly
(74) *Attorney, Agent, or Firm* — James E. Howard; Andre Pallapies

(57) ABSTRACT

A dishwasher and a method for operating a dishwasher having a washing receptacle; at least two spraying devices located within the washing receptacle; a reversing device; a drive in functional connection with the reversing device in order to bring the reversing device into different positions; and a circulation pump which, depending on a set position of the reversing device, conveys liquid to at least one of the at least two spraying devices. The method includes controlling the drive such that the reversing device assumes a predefined starting position; and controlling the drive such that, based on the predefined starting position, the reversing device assumes a specific position.

14 Claims, 3 Drawing Sheets

APPARATUS AND METHOD FOR THE OPERATION OF A DISHWASHER

BACKGROUND OF THE INVENTION

The invention relates to a method for the operation of a dishwasher.

DE 198 57 101 B4 discloses a dishwasher with a washing receptacle, a circulation pump, two spraying arms located in the washing receptacle, which can be supplied with liquid by means of the circulation pump, a flow-through water heater positioned downstream of the circulation pump and a reversing device. The reversing device is controlled by a drive, having a motor, in such a way that in each case one of the spraying arms, neither of the spraying arms or both spraying arms are supplied with the liquid. A microswitch for controlling the drive can detect the position of the reversing device.

BRIEF SUMMARY OF THE INVENTION

The object of the invention is to specify a method for the operation of a dishwasher, by means of which the reversing device can be brought into its positions in a relatively simple manner.

A further object of the invention is to specify a dishwasher which can perform this method.

The object of the invention is achieved by means of a method for the operation of a dishwasher, which comprises washing receptacle, at least two spraying devices located within the washing receptacles, for example two spraying arms or one spraying arm and one overshower, a reversing device, a drive in functional connection with the reversing device, in order to bring the reversing device into different positions, and a circulation pump, which depending on the set position of the reversing device, conveys liquid to one of the two and/or to both spraying devices, having the following method steps:

actuation of the electric drive in such a way that the reversing device assumes a predefined starting position, and actuation of the electric drive in such a way that the reversing device assumes a specific position.

The further object of the invention is achieved by a dishwasher, having a washing receptacle, at least two spraying arms located within the washing receptacle, a reversing device, and a drive in functional connection with the reversing device, in order to bring the reversing device into different positions, and a control device for actuation of the drive and a circulation pump, which depending on the set position of the reversing device, conveys liquid to one and/or to both spraying devices. The control device is set up to control the drive in such a way that the reversing device initially assumes a predefined starting position and the reversing device subsequently assumes a specific position.

Accordingly, the inventive dishwasher has the washing receptacle and the spraying devices located in the washing receptacle. The spraying devices are for example spraying arms. During operation of the dishwasher, the circulation pump conveys the liquid usually designated as washing liquid, to the spraying devices. Depending on the washing program it can for example be provided for only one of the spraying devices in each case, on an alternating basis, or groups of spraying devices to be fed with liquid. So that the circulation pump can convey the liquid to the desired spraying devices, the inventive dishwasher comprises a reversing device, which for example is also designated as a water distributor. The reversing device is, for example, positioned between the circulation pump and feed lines for the spraying devices. Depending on the position of the reversing device, the circulation pump for example only conveys liquid to the spraying device assigned to a particular position of the reversing device.

The reversing device has, for example, a valve body or a sealing washer, which seals that feed channel of the spraying device, to which no liquid is to be conveyed. The reversing device has a drive, in order to be able to set the individual positions of the reversing device. The drive can comprise a motor, in particular an electric motor such as for example a stepping motor or other suitable drive means, such as electromagnets or pneumatic or hydraulic means. The individual positions of the reversing device can be set by means of rotation of the motor or rotation of the shaft of the motor of the electric drive, in that the motor for example brings the sealing washer into the desired position through rotation.

So that the reversing device is located in the desired location, the electric motor of the drive must be rotated until the reversing device is in the desired position. So that this is possible without feedback on the current position of the reversing device to the control device, then according to the invention the electric drive is initially controlled in such a way that the motor brings the reversing device into the predefined starting position. The starting position can for example correspond to one of the positions of the reversing device. Thereafter, the electric drive is controlled by the control device for example in such a way that its motor, commencing from the starting position, rotates by a predefined angle. This predefined angle is selected such that when the reversing device is initially located in it starting position and the motor has rotated by the predefined angle, the reversing device is located in the specific position. Feedback to the effect that the reversing device is actually in the specific position is not necessary, for which reason the inventive dishwasher can dispense with a corresponding feedback device, such as for example the microswitch known from DE 198 57 101 B4. The number of components required for the inventive dishwasher is thereby reduced, thus permitting a more cost-effective manufacturing process. It is also possible to increase the positioning accuracy of the positioning device, as switching tolerances of the microswitch are not a factor.

As well as the motor, the electric drive has, for example, an inverter or inverse rectifier, which is controlled by the control device and drives the motor. Inverse rectifiers or inverters are generally known, and comprise for example suitable power components. Depending on the motor employed, the inverse rectifier or inverter can generate an AC or three-phase current.

In order to detect when the motor has rotated by the predefined angle, then according to an embodiment of the inventive method or the inventive dishwasher the zero crossings of the Back emf of the motor are in particular determined by the control device, while the motor rotates by the predefined angle, and the electric drive in particular is controlled by the control device until a number of zero crossings of the Back emf assigned to the predefined angle of the motor has been determined. If, for example, the motor has a single pole rotor, then two zero crossings of the Back emf correspond to a complete rotation of the motor, that is an angle of $2\pi$ or 360°. Counting the zero crossings of the Back emf commencing from the starting position can thus indicate the angle, through which the motor has rotated. Accordingly it is possible, based on the zero crossings of the Back emf, to conclude when the motor has rotated by the predefined angle.

According to one variant of the inventive method or the inventive dishwasher, the electric drive is in particular controlled by the control device such that the motor rotates in a first direction of rotation until the reversing device is located in its starting position and blocks a further rotation of the motor in the direction of the first direction of rotation. By means of the blocking of the motor in the starting position of the reversing device, it is possible, relatively reliably, to bring the reversing device into its starting position by means of the electric drive.

The blocking can be realized relatively simply, if according to one embodiment of the inventive method or the inventive dishwasher, the reversing device comprises a mechanical blocking means, which prevents further rotation of the motor in the direction of its first direction of rotation upon reaching the starting position. Suitable blocking means are, for example, a retaining pawl or a hard stop. The retaining pawl has the advantage that it blocks the motor only in one direction of rotation, here in the direction of the first direction of rotation. It is thereby possible to rotate the motor initially in the direction of the first direction of rotation, until the reversing device has reached the starting position. For setting the desired positions of the reversing device, the motor can then always be rotated by a predefined angle in the direction of rotation differing from the first direction of rotation.

When the motor is blocked, at least one operating parameter of the electric drive changes. According to one variant of the inventive method or the inventive dishwasher, provision is made for the attainment of the starting position of the reversing device to be detected in particular by means of the control device based on at least one operating parameter of the electric drive, and the electric drive then to be stopped. The operating parameter of the electric drive is for example an electric current and/or an electrical power of the electric drive and/or a torque delivered by the motor. Upon blocking of the motor its load increases, and accordingly also its electrical current. For example the reaching of a predefined threshold value indicates blocking of the motor and thus attainment of the starting position of the reversing device.

If the electric drive controlled is such a way that the motor rotates in the direction of the first direction of rotation, until the reversing device has reached the starting position, then the electric drive can in particular be controlled in such a way by the control device that the motor rotates by the predefined angle in a second direction of rotation which differs from the first direction of rotation.

According to one embodiment of the inventive method or the inventive dishwasher, the electric drive in particular is controlled by the control device in such away that the motor alternately rotates in the clockwise direction and in the counter-clockwise direction by the predefined angle. This variant is an option in particular in the case of so-called alternate basket washing, in which the circulation pump conveys liquid to the individual spraying devices in succession. According to this variant, the reversing device is switched to and from between two positions, in that the motor rotates alternately in the clockwise direction and in the counter-clockwise direction by the predefined angle. A relatively rapid switch between the two spraying devices is thereby possible.

According to one variant of the inventive method or the inventive dishwasher, at least one operating parameter of the electric drive is monitored while the motor rotates by the predefined angle, in order to detect a blocking of the motor. If a blocking of the motor is detected, countermeasures are then initiated. Suitable countermeasures are for example a reduction in the pressure of the hydraulic circuit of the dishwasher and/or an actuation of the electric drive such that the motor changes its current direction of rotation. In the event of the blocking of the motor its load increases as do the electric current or the electrical power of the electric drive. Suitable operating parameters are an electric current and/or an electrical power of the electric drive. The monitoring can for example be realized in that the control device monitors the current consumption or the power consumption of the electric drive and upon a threshold value being reached, the countermeasures are initiated. At least within certain limitations, self-repair of the inventive dishwasher can thus be achieved.

If the electric drive for the reversing device comprises the inverter or inverse rectifier, this can then also be used for a motor to drive a drain pump of the dishwasher, as the drain pump is not in operation when the reversing device is being adjusted.

BRIEF DESCRIPTION OF THE DRAWINGS

Exemplary embodiments of the invention are shown by way of example in the attached schematic diagrams, wherein.

DETAILED DESCRIPTION OF EXEMPLARY EMBODIMENTS OF THE PRESENT INVENTION

Figure 1:
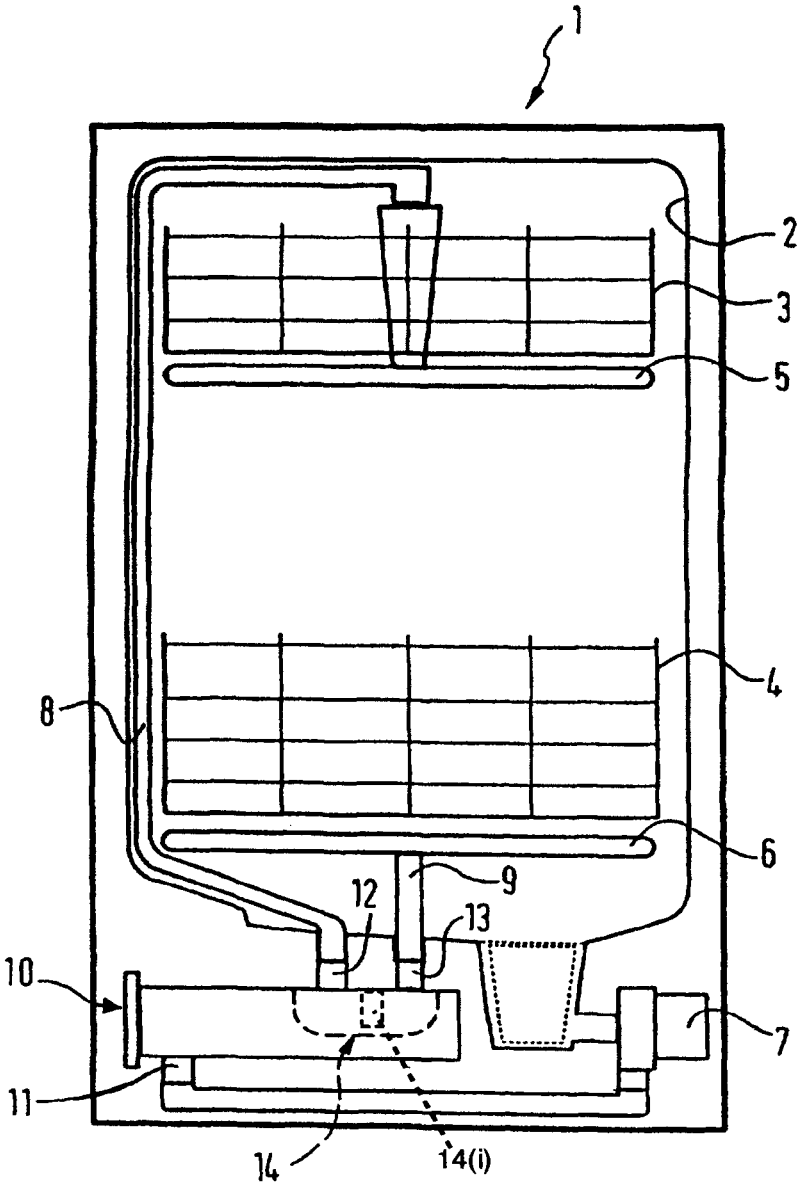
FIG. 1 shows a dishwasher with a water distributor.
Figure 2:
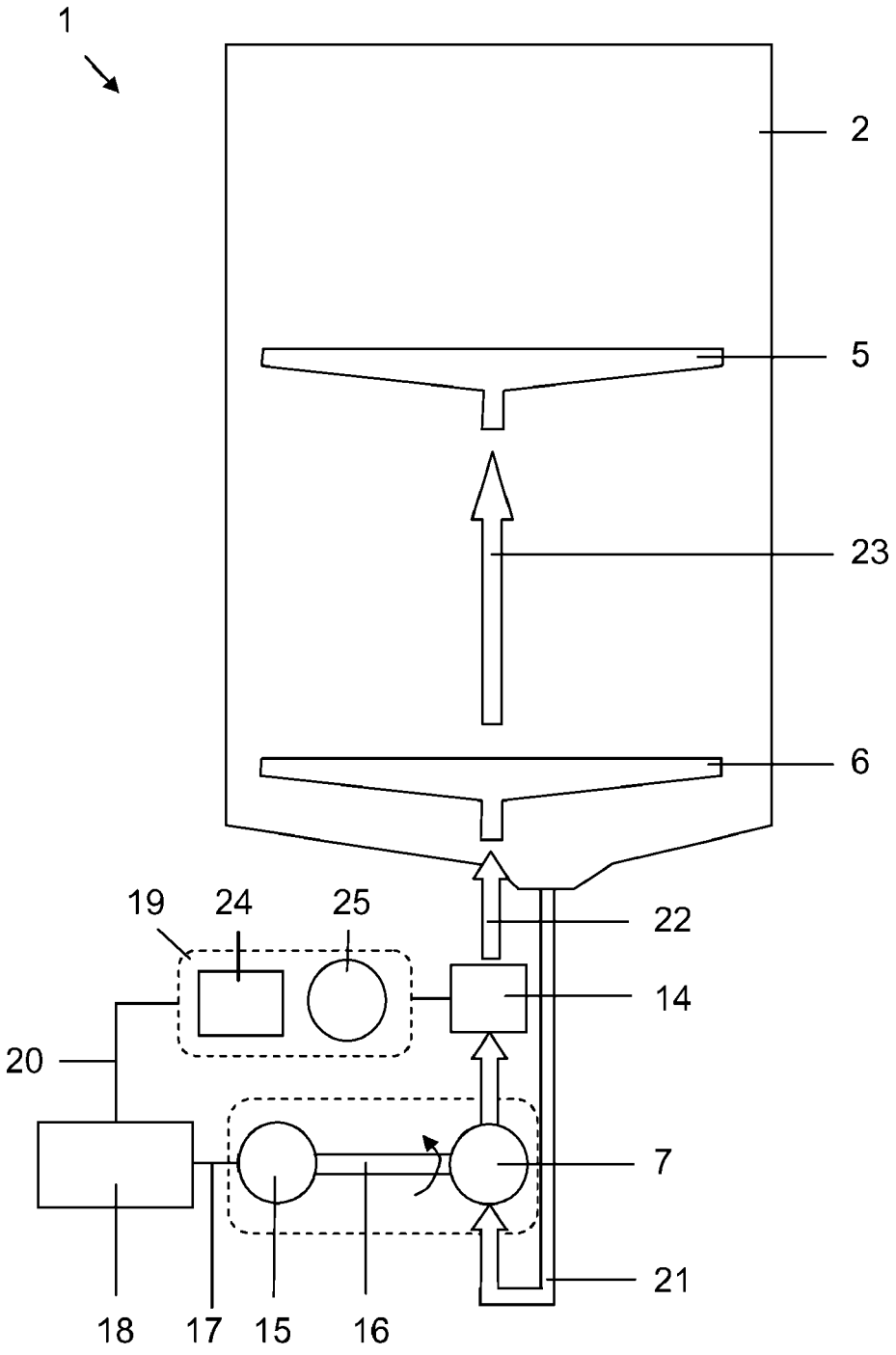
FIG. 2 shows a schematic diagram of the dishwasher.

FIG. 1 shows a dishwasher 1 and FIG. 2 shows a schematic diagram of the dishwasher 1, which has a washing receptacle 2 to accommodate items to be washed, for example soiled crockery and cutlery, which for example is located in an upper basket 3 and a lower basket 4. In the washing receptacle 2 are located at least two spraying devices, which, in the case of the present exemplary embodiment, are designed as upper and lower spraying arms 5, 6, for the treatment of the items to be washed with a liquid, which is generally designated as a washing liquor. The liquid can be conveyed by a circulation pump 7 via a first liquid feed line 8 to the upper spraying arm 5 and via a second liquid feed line 9 to the lower spraying arm 6. This is illustrated in FIG. 2 by means of arrows 21-23. The circulation pump 7 is for example driven by means of an electric drive 15, in particular by means of its electric motor via a shaft 16.

In the case of the present exemplary embodiment the liquid is heated, at least in a subprogram step of a washing program of the dishwasher 1, by a flow-through water heater 10, which is connected with an inlet stub 11 to the circulation pump 7 and with output stubs 12, 13 to the liquid feed lines 8, 9. The number of output stubs 12, 13 corresponds to the number of the spraying arms 5, 6 or simultaneously operated groups of spraying arms 5, 6. The liquid conveyed by the circulation pump 7 is accordingly in the case of the present exemplary embodiment directed to the inlet stub 11 of the flow-through water heater 10 and from its output stubs 12, 13 via the liquid feed lines 8, 9 to the spraying arms 5, 6.

The electric drive 15 is connected with a control device 18 of the dishwasher 1 by means of an electric line 17, so that the control device 18 can control and also regulate the electric drive 15 in a generally known manner. The control device 18 comprises for example a suitably programmed microprocessor and is generally provided to control the dishwasher 1 in such away that this performs the washing program.

The dishwasher 1 further has a reversing device, in particular a water distributor 14, which for example is located in the flow-through water heater 10 or formed on it. However the water distributor 14 can for example also be located separately in the dishwasher 1 or connected directly to the circulation pump 7.

By means of the water distributor 14 the spraying arms 5, 6 can in each case be fed alternately and/or constantly with the liquid, which is achieved through the opening of one liquid outlet and closure of a different liquid outlet of the water distributor 14. In the present exemplary embodiment the liquid outlets of the water distributor 14 pass directly into the output stubs 12, 13 or are identical to these. The water distributor 14 further has a liquid inlet, which in the case of the present exemplary embodiment connects to the inlet stub 11 or is formed by this. In the case of the present exemplary embodiment a valve body or a sealing washer is adjusted by a drive, in particular an electric drive 19, to close the liquid outlet.

By means of an electric line 20 the electric drive 19 is connected to the control device 18 and is controlled by the latter. In particular the electric drive 19 is embodied in such a way that its direction of rotation can be changed through appropriate actuation by the control device 18. So that the direction of rotation of the electric drive 19 can be changed, in the case of the present exemplary embodiment the electric drive 19 comprises a BLDC or a BLAC motor 25, that is a three-phase synchronous motor, and an inverse rectifier or inverter 24 controlling the motor 25. The inverter 24 generates the necessary electric three-phase voltage for the motor 25, that is the requisite frequency and the necessary root mean square of the electrical voltage. Suitable inverters 24 have for example power semiconductors, and are generally known to the person skilled in the art, for which reason no further explanation of the precise structure of the inverter 24 is offered.

During operation of the dishwasher 1 the electric drive 19 moves the sealing washer 14(*i*) of the water distributor 14, altering the water distributor position and thereby the patterns of water distribution through the water distributor to the spraying arms 5 and 6. In the case of the present exemplary embodiment the water distributor 14 comprises an excenter 27 shown in FIG. 3 and mounted in a rotatable manner in relation to an axis of rotation 26, with an eccentricity 28. The motor 25 of the electric drive 19 is in functional connection with the excenter 27, for example via a coupling, which is not shown, or transmission, which is not shown, or also directly, so that the motor 25 rotates the excenter 27, at least indirectly. The excenter 27 is in turn in functional connection with the sealing washer 14(*i*) of the water distributor 14, so that in the case of a rotation of the excenter 27 about the axis of rotation 26, the sealing washer 14(*i*) is displaced, and the water distributor thus assumes different positions, in which the circulation pump 7 for example can convey liquid only to the upper spraying arm 5 or only to the lower spraying arm 6.

Figure 3:
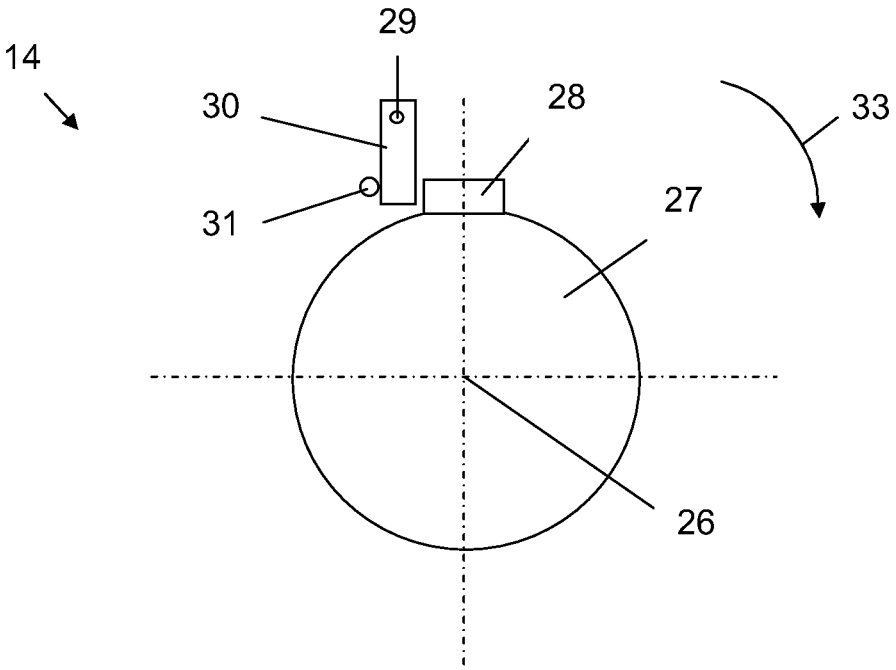
FIG. 3 shows part of the water distributor.

In the case of the present exemplary embodiment, the water distributor 14 further has a retaining pawl 30 with a rigid locking pin 31 mounted in relation to an axle 29, by means of which the excenter 27 can be brought into a predefined starting position, in which the eccentricity 28 is oriented in a predefined starting position. This position is shown in FIG. 3 and corresponds to the starting position of the water distributor 14. The starting position corresponds in particular to a position of the water distributor 14, in which the circulation pump 7 only conveys liquid to one of the spraying arms 5, 6, for example to the upper spraying arm 5.

In the case of the present exemplary embodiment, the retaining pawl 30 is located in such a way that with a rotation of the excenter 27 in the clockwise direction, that is in the direction of an arrow 33, the excenter 27 or its eccentricity 28 can turn the retaining pawl 30 away in relation to the axle 29. In this way, the motor 25 can rotate the excenter 27 in the clockwise direction at will.

If on the other hand the excenter 27 rotates in the counter-clockwise direction, that is in the opposite direction to the arrow 33, then in the case of the position of the excenter 27 shown in FIG. 3, the eccentricity 28 presses the retaining pawl 30 against the locking pin 31 and thereby prevents a further rotation of the excenter 27. It is thereby possible to move the excenter 27 into the predefined starting position shown in FIG. 3, in which the water distributor 14 is in its in predefined starting position.

During operation of the dishwasher 1, for example at the start of a washing program or at the start of a subprogram step of the washing program, the control device 18 or a computer program running on the control device 18 controls the electric drive 19 in such a way that the motor 25 or its shaft rotates in a first direction of rotation, whereby the excenter 27 rotates in the counter-clockwise direction until the retaining pawl 30 halts it. The counter-torque or the load of the motor 25 thereby increases, as a result of which the electric current of the electric drives 19 increases. The control device 18 recognizes this, by, for example, comparing the electric current of the electric drive 19 with a predefined threshold value, and stops the electric drive 19. The water distributor 14 is thus located in its predefined starting position.

During the washing program, if applicable the control device 18 controls the electric drive 19 in such a way that its electric motor 25 rotates in a second direction of rotation, so that the excenter 27 rotates in the clockwise direction. Depending on the position of the excenter 27, the sealing washer closes the liquid outlets of the water distributor 14 in such a way that in the case of the present exemplary embodiment in particular, the circulation pump 7 conveys liquid either only to the upper spraying arm 5 or only to the lower spraying arm 6.

The positions of the sealing washer of the water distributor 14 correspond to positions of the excenter 27. In the case of the present exemplary embodiment these are set in such a way that, based on the preset starting position of the water distributor 14, the control device 18 controls the electric drive 19 in such a way that its motor 25 rotates in its second direction of rotation by a predefined angle. The motor 25 thereby rotates the excenter 27 accordingly by a predefined angle in the clockwise direction, whereby the desired positions of the water distributor 14 are established. It is thus only necessary that the control device 18 controls the electric drive 19 during the washing program in such a way that its motor 25 rotates by a predefined angle, based on the starting position, in relation to the second direction of rotation.

In the case of the present exemplary embodiment, the predefined angles are recognized on the basis of the zero crossings of the Back emf of the motor 25 of the electric drive 19. If, for example, the motor 25 has a single pole rotor, as provided for in the present exemplary embodiment, then two zero crossings of the Back emf correspond to a complete rotation of the motor 25. In order to set the desired position of the water distributor 14, that is in order to set the desired position of the sealing washer of the water distributor 14, then in the case of the present exemplary embodiment, the zero crossings of the Back emf of the motor 25 required for the desired rotation of the motor 25 in its second direction of rotation are, for example, stored in a memory of the control device 18 (not shown). During the washing program the control device 18 can thus, based on the measured zero crossings of the Back emf of the motor 25, rotate the latter by the predefined angle, in order to bring the water distributor 14 or its sealing washer into the desired positions.

In the case of the present exemplary embodiment operation of the dishwasher 1 in so-called alternate basket washing mode is provided for in at least in one subprogram step. In this operating mode only one of the two spraying arms 5, 6 is fed with liquid, on an alternating basis. If the dishwasher 1 is in alternate basket washing mode, then the control device 18 controls the electric drive 19 in such a way that its motor 25, initially from its starting position, which in the case of the present exemplary embodiment corresponds to the position of the water distributor 14, in which the circulation pump 7 only conveys liquid to the upper spraying arm 5, rotates by the predefined angle in the clockwise direction, in order to bring the water distributor 14 into a position in which the circulation pump 7 only conveys liquid to the lower spraying arm 5. After a predefined period of time, the control device 18 controls the electric drive 19 in such a way that the motor 25 rotates in the counter-clockwise direction by the predefined angle, whereby the water distributor 14 is once more brought into the position in which the circulation pump 7 only conveys liquid to the upper spraying arm 5. This is repeated as often as desired.

Alternatively, in the alternate basket washing mode, it can be provided for the control device 18 to control the electric drive 19, from the starting position in such a way that its motor 25 initially rotates from its starting position by the predefined angle in the clockwise direction, in order to bring the water distributor 14 into a position in which the circulation pump 7 only conveys liquid to the lower spraying arm 5. After a predefined period the control device 18 controls the electric drive 19 in such away that the motor 25 further rotates in the clockwise direction through a further predefined angle, in order to return the water distributor 14 to the position in which the circulation pump 7 only conveys liquid to the upper spraying arm 5. As the excenter 27 is not blocked by the retaining pawl 30, when the motor 25 rotates in the clockwise direction, this program can be repeated as often as desired.

In the case of the present exemplary embodiment it is further provided for the control device 18 to monitor the level of the electric current of the electric drive 19, for example its root mean square. If due to an excessively high counter-torque, the motor 25 is blocked at the sealing washer, because for example a foreign body is hindering or blocking movement of the sealing washer, then the electric current of the electric drive increases. It is thus possible, based on the monitoring of the electric current of the electric drive 19 to conclude that a prohibited operating status exists, so that for example the control device 18 can initiate suitable countermeasures. Suitable countermeasures are for example a reduction in pressure in the hydraulic circuit of the dishwasher 1 or an actuation of the electric drive 19 such that this changes its current direction of rotation. Monitoring of the electric current can for example be realized in that the control device 18 compares the root mean square of the electric current with a predefined maximum value and initiates the countermeasures if the root mean square of the electric current exceeds the maximum value.

Figure 4:
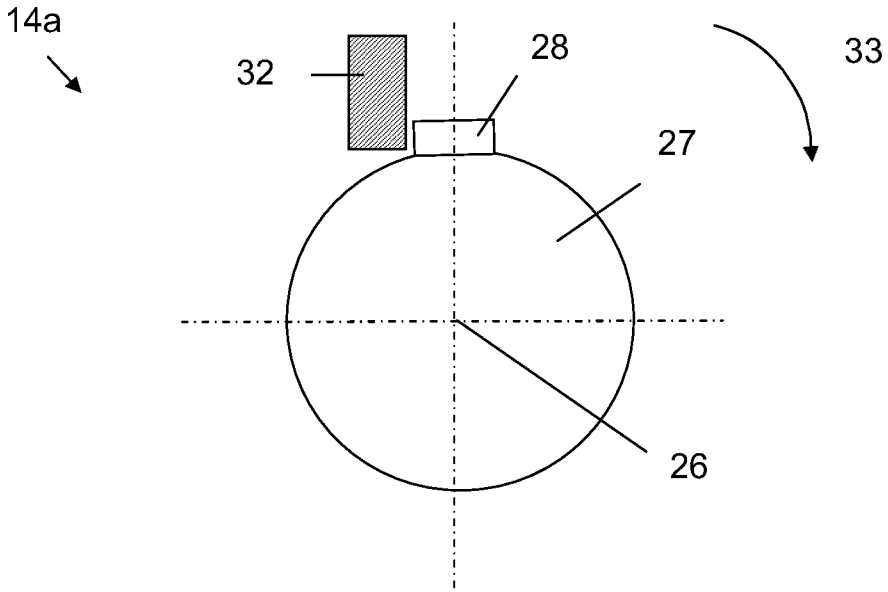
FIG. 4 shows part of an alternative water distributor.

FIG. 4 shows part of an alternative water distributor 14*a*, which can be used for the dishwasher 1 instead of the water distributor 14. The water distributor 14*a* essentially differs from the water distributor 14 in that the water distributor 14*a* has no retaining pawl 30, but an immovable hard stop 32. The excenter 27 can therefore essentially only execute a full rotation.

If the dishwasher 1 is provided with the water distributor 14*a*, then in the case of the present exemplary embodiment, for example at the start of a washing program or a subprogram step of the washing program, the control device 18 controls the electric drive 19 in such a way that the motor 25 rotates in its first direction of rotation, whereby the excenter 27 rotates in the counter-clockwise direction until the hard stop 32 halts it. The control device 18 detects this based on the increasing electric current of the electric drive 19, and stops it. The water distributor 14*a* is thereby in its predefined starting position, in which, for example, the circulation pump can only convey liquid to the upper spraying arm 5.

During the washing program, if applicable the control device 18 controls the electric drive 19 in such away that its electric motor 25 initially rotates in its second direction of rotation, so that the excenter 27 rotates in the clockwise direction, until the excenter 27 assumes a further position of the water distributor 14*a*, in which the circulation pump 7 can, for example, only convey liquid to the lower spraying arm 6. The control device 18 determines the angle through which the motor 25 is to travel based on predefined zero crossings of the Back emf of the motor 25 of the electric drive 19.

As the water distributor 14*a* has the hard stop 32, the electric drive 19 cannot rotate the excenter 27 in the clockwise direction at will. In the case of the present exemplary embodiment it is thus provided for the control device 18 to control the electric drive 19 for an adjustment water distributor 14*a* in such a way that its motor 25 changes its direction of rotation if applicable, and rotates in the changed direction of rotation for example through a further predefined angle.

The invention claimed is:

1. A dishwasher, comprising:

a washing receptacle with at least two spraying devices;

a rotatable reversing device;

a drive motor;

a control device configured to stop the drive motor from a first direction of rotation, based on a predefined threshold value provided to the control device from the drive motor; and a mechanical block; wherein the drive motor is physically linked to the rotatable reversing device, is structured to rotate the rotatable reversing device, and is configured to provide changes in at least one drive motor operating parameter to the control device including the predefined threshold value that informs the control device that the rotatable reversing device is blocked by the mechanical block; and wherein the drive motor positions the rotatable reversing device to a predefined starting position, as controlled by the control device on detection of the predefined threshold value, for water distribution to the washing receptacle when the rotatable reversing device is blocked by the mechanical block.

2. The dishwasher of claim 1, wherein the drive motor includes an electric motor.

3. The dishwasher of claim 1, wherein the control device is configured to control the drive motor so that the rotatable reversing device is positioned to a specific position subsequent to the predefined starting position, in a feedback-free manner.

4. The dishwasher of claim 1, wherein the control device is structured to control the drive by rotation by a predefined angle.

5. The dishwasher of claim 1, wherein the predefined starting position corresponds to one of different positions of the rotatable reversing device.

6. The dishwasher of claim 2, wherein the control device is structured to determine zero crossings of Back emf of the electric motor while the electric motor rotates by a predefined angle; and wherein the control device is structured to control the drive motor until the control device has determined a predetermined number of the zero crossings of the Back emf that is assigned to the predefined angle of the electric motor.

7. The dishwasher of claim 1, wherein the mechanical block includes one of a retaining pawl and a hard stop.

8. The dishwasher of claim 2, wherein the control device is structured to stop the drive motor depending on the at least one drive motor operating parameter.

9. The dishwasher of claim 8, wherein the at least one drive motor operating parameter is at least one of an electric current, an electrical power of the drive, and a torque conveyed by the electric motor.

10. The dishwasher of claim 2, wherein the control device is structured to control the drive motor such that the electric motor rotates by a predefined angle in a second direction of rotation which differs from the first direction of rotation.

11. The dishwasher of claim 10, wherein the control device is structured to control the drive such that the electric motor rotates by the predefined angle alternately in a clockwise direction and in a counter-clockwise direction.

12. The dishwasher of claim 2, wherein the control device is structured to monitor the at least one drive motor operating parameter while the electric motor rotates by a predefined angle in order to detect a blocking of the electric motor with the mechanical block, and wherein the control device is structured to initiate countermeasures when the control device has detected that the electric motor is blocked.

13. The dishwasher of claim 12, wherein the at least one drive motor operating parameter is at least one of an electric current and an electrical power of the drive.

14. The dishwasher of claim 12, wherein the countermeasures comprise at least one of pressure of a hydraulic circuit of the dishwasher being reduced and the drive motor being actuated such that the electric motor rotates against a current direction of rotation.

* * * * *